US010580606B2

(12) United States Patent
Kozar et al.

(10) Patent No.: US 10,580,606 B2
(45) Date of Patent: Mar. 3, 2020

(54) ARTICULATED CLINCH JOINT FOR MOLDED CASE CIRCUIT BREAKER

(71) Applicant: Eaton Intelligent Power Limited, Dublin (IE)

(72) Inventors: Aaron Thomas Kozar, Zelienople, PA (US); Robert Michael Slepian, Murrysville, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/199,481

(22) Filed: Nov. 26, 2018

(65) Prior Publication Data

US 2019/0096617 A1 Mar. 28, 2019

Related U.S. Application Data

(63) Continuation of application No. 14/867,279, filed on Sep. 28, 2015, now Pat. No. 10,153,119.

(51) Int. Cl.

| | |
|---|---|
| ***H01H 71/10*** | (2006.01) |
| ***H01H 71/43*** | (2006.01) |
| ***H01H 71/02*** | (2006.01) |
| *H01H 3/22* | (2006.01) |
| *H01H 71/52* | (2006.01) |

(52) U.S. Cl.

CPC ..... *H01H 71/10* (2013.01); *H01H 71/02* (2013.01); *H01H 71/43* (2013.01); *H01H 3/222* (2013.01); *H01H 71/525* (2013.01); *H01H 2205/002* (2013.01)

(58) Field of Classification Search

CPC ..... H01H 71/10; H01H 71/43; H01H 71/02; H01H 71/525; H01H 2205/002; H01H 3/222

USPC ..... 200/244, 400, 401, 335, 337, 338

See application file for complete search history.

(56) References Cited

U.S. PATENT DOCUMENTS

| | | | |
|---|---|---|---|
| 4,245,203 | A | 1/1981 | Wafer et al. |
| 4,563,557 | A | 1/1986 | Leone |
| 4,644,121 | A | 2/1987 | McKee et al. |
| 4,771,254 | A | 9/1988 | DiVincenzo |
| 4,864,261 | A | 9/1989 | Kandatsu |
| 4,894,747 | A | 1/1990 | Livesey et al. |
| 4,973,927 | A | 11/1990 | Carothers et al. |
| 5,146,194 | A | 9/1992 | Altenhof, Jr. et al. |
| 5,318,121 | A | 6/1994 | Brockman et al. |

(Continued)

*Primary Examiner* — Edwin A. Leon
*Assistant Examiner* — Lheiren Mae A Caroc
(74) *Attorney, Agent, or Firm* — Eckert Seamans Cherin & Mellott, LLC

(57) ABSTRACT

A movable contact conductor assembly is provided. The movable contact arm assembly includes an elongated member with a distal tip, a first end, a medial portion, an actuator coupling second component, a primary pivot second component, a secondary pivot second component, a clinch joint second component, a second end, and a proximal tip. During an over-current event the movable contact arm assembly member generates a loop force. A loop force first portion is disposed on a first longitudinal side of the movable contact arm assembly member primary pivot second component, and, a loop force second portion is disposed on a second longitudinal side of the movable contact arm assembly member primary pivot second component.

4 Claims, 5 Drawing Sheets

(56) References Cited

U.S. PATENT DOCUMENTS

| | | | | |
|---|---|---|---|---|
| 7,238,910 | B1 | 7/2007 | Puskar et al. | |
| 10,153,119 | B2 * | 12/2018 | Kozar | H01H 71/02 |

* cited by examiner

ARTICULATED CLINCH JOINT FOR MOLDED CASE CIRCUIT BREAKER

CROSS REFERENCE TO RELATED APPLICATION

This application is a continuation application of and claims priority to U.S. patent application Ser. No. 14/867,279, filed Sep. 28, 2015, entitled ARTICULATED CLINCH JOINT FOR MOLDED CASE CIRCUIT BREAKER.

FIELD OF THE INVENTION

The disclosed and claimed concept relates to a circuit breaker and, more specifically, to a circuit breaker operating mechanism that is structured to resist rebounding from an open, first configuration to a closed, second configuration.

BACKGROUND INFORMATION

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers, are well known in the art. Circuit breakers are used to protect electrical circuitry from damage due to an over-current condition, such as an overload condition or a relatively high level short circuit or fault condition. Circuit breakers typically include a number of pairs of separable contacts, an operating mechanism, and a trip unit. The separable contacts move between on open, first configuration and a closed, second configuration. The separable contacts may be operated either manually by way of a handle disposed on the outside of the case or automatically in response to an over-current condition. That is, a circuit breaker includes an operating mechanism and a trip unit. The operating mechanism is designed to rapidly open and close the separable contacts. The operating mechanism is structured to be latched and thereby maintain the contacts in a closed configuration. The trip unit is structured to detect over-current conditions. When an over-current condition is detected, the trip unit releases the operating mechanism latch thereby allowing biasing elements to bias the operating mechanism and contacts, to an open configuration.

Generally, a circuit breaker is assigned a size and a "withstand" value. The size of the circuit breaker is substantially related to the size of the circuit breaker housing assembly or frame. Generally, a withstand value at 10× rated current is typical, or desired, for molded case circuit breakers and miniature circuit breakers. Other classes of breakers, such as, but not limited to, power circuit breakers and medium voltage breakers, have a withstand value to equal their interruption rating. The circuit breaker withstand value involves a balance between blow-off forces generated by electric currents flowing in the breaker and contact forces generated on the movable conductor by the operating mechanism. Thus, as the rated current for a given frame size is increased, the withstand value should be increased a corresponding amount. This relationship is, however, limited by the size, shape, configuration, and material properties of the elements of the circuit breaker. That is, as the withstand value is increased, the components of the circuit breaker must become more robust. Typically, the size of the circuit breaker elements is increased so as to increase their strength. The size of the circuit breaker housing assembly, however, limits the increase in the size of the internal elements. That is, if the size of the circuit breaker frame or housing assembly is increased to accommodate the larger components, the circuit breaker could not be considered to be of a selected size.

There is, therefore, a need for a circuit breaker having a greater withstand value while maintaining the size of the circuit breaker housing assembly. There is a further need for an improved conductor assembly that may be incorporated into existing circuit breakers.

SUMMARY OF THE INVENTION

These needs, and others, are met by at least one embodiment of this invention which provides for a movable contact conductor assembly wherein loop forces generated in a movable contact arm assembly member are disposed on either side of a primary pivot point for the movable contact arm assembly member. In this configuration, the withstand value of the circuit breaker assembly is increased while maintaining the circuit breaker housing assembly size. That is, a circuit breaker assembly of a selected size has a greater withstand value. Thus, it is noted that the size, shape, and configuration of the elements described below solve the stated problem.

In an exemplary embodiment, a movable contact arm assembly includes an elongated member with a distal tip, a first end, a medial portion, an actuator coupling second component, a primary pivot second component, a secondary pivot second component, a clinch joint second component, a second end, and a proximal tip. During an over-current event the movable contact arm assembly member generates a loop force. A loop force first portion is disposed on a first longitudinal side of the movable contact arm assembly member primary pivot second component, and, a loop force second portion is disposed on a second longitudinal side of the movable contact arm assembly member a primary pivot second component. In this configuration, the portions of the loop force acting on different sides of the primary pivot counteract each other thereby reducing the force acting on the movable contact arm body as well as the force transferred to the circuit breaker housing assembly. Thus, for a circuit breaker housing assembly of a selected size, the movable contact arm assembly provides a greater withstand value compared to known movable contact arm assemblies.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
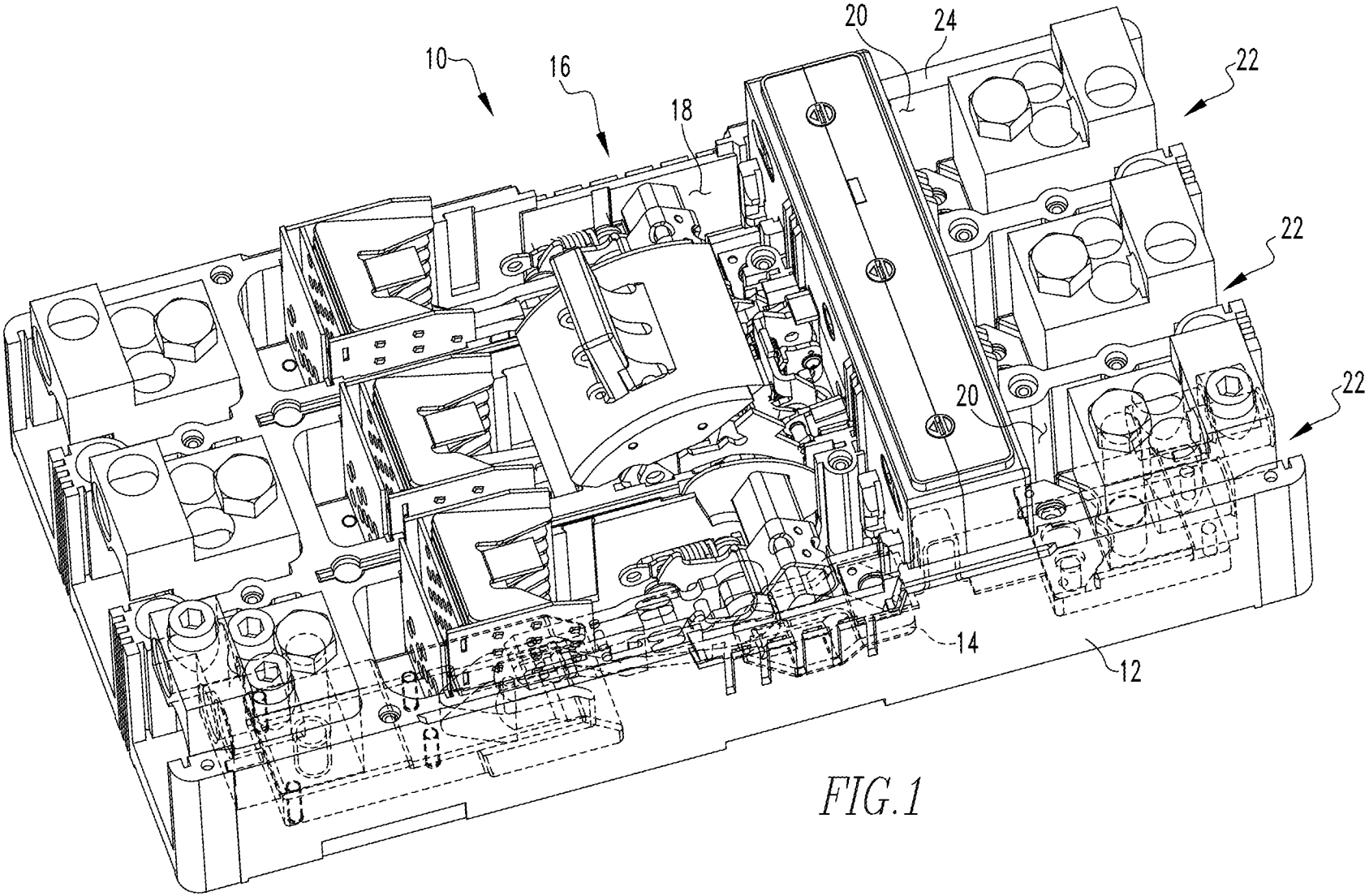
FIG. 1 is an isometric view of a circuit breaker assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts, such as but not limited to circuit breaker contacts, are "directly coupled" when in one position, e.g., the closed, second position, but are not "directly coupled" when in the open, first position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function.

As used herein, and in the phrase "[x] moves between a first position and a second position corresponding to [y] first and second positions," wherein "[x]" and "[y]" are elements or assemblies, the word "correspond" means that when element [x] is in the first position, element [y] is in the first position, and, when element [x] is in the second position, element [y] is in the second position. It is noted that "correspond" relates to the final positions and does not mean the elements must move at the same rate or simultaneously. That is, for example, a hubcap and the wheel to which it is attached rotate in a corresponding manner. Conversely, a spring biased latched member and a latch release move at different rates. That is, as an example, a latch release moves between a first position, wherein the latched member is not released, and a second position, wherein the latched member is released. The spring-biased latched member moves between a first latched position and a second released position. The latch release may move slowly between positions and, until the release is in the second position, the latched member remains in the first position. But, as soon as the latch release reaches the second position, the latched member is released and quickly moves to the second position. Thus, as stated above, "corresponding" positions mean that the elements are in the identified first positions at the same time, and, in the identified second positions at the same time.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "in electronic communication" is used in reference to communicating a signal via an electromagnetic wave or signal. "In electronic communication" includes both hardline and wireless forms of communication; thus, a "data transfer" or "communication method" means that a module transfer data from one computer to another computer (or from one processing assembly to another processing assembly) by physical connections such as USB, Ethernet connections or remotely such as NFC, blue tooth etc. should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

Figure 2:
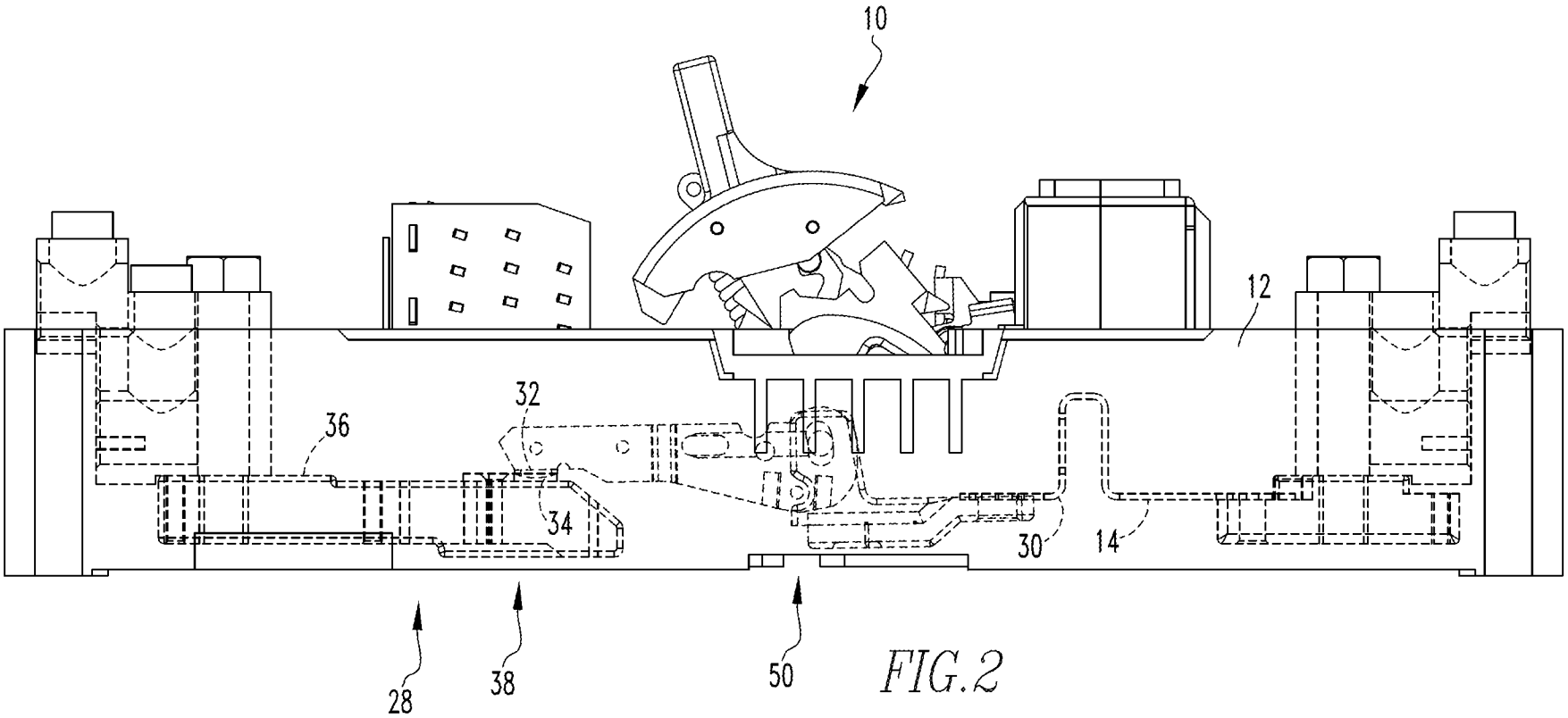
FIG. 2 is a side view of a circuit breaker assembly.

As shown in FIGS. 1 and 2, and as is known, a circuit breaker assembly 10 includes an elongated housing assembly 12 (with the cover removed), a conductor assembly 14, an operating mechanism 16, a trip unit assembly, (not shown) as well as other components. The housing assembly 12 is made from a non-conductive material and defines an enclosed space 18 wherein the other components may be disposed. The housing assembly enclosed space 18 is, in an exemplary embodiment, generally divided into a number of longitudinal cavities 20 including, or which may also be identified as, a number of elongated channels 22. Other cavities, such as, but not limited to, a cavity for the operating mechanism 16 extend laterally across the longitudinal cavities 20. The housing assembly 12, in an exemplary embodiment, includes a number of support members 24. The housing assembly support members 24 act as mounting or coupling locations, including but not limited to rotatable coupling locations, for various elements of the circuit breaker 10.

Each conductor assembly 14 includes a fixed contact conductor assembly 28 and a movable contact conductor assembly 50, discussed below. Generally, a conductor assembly 14 includes, but is not limited to, a load bus 30, a movable contact 32, (the movable contact conductor assembly 50) a fixed contact 34, and a line bus 36 (the fixed contact conductor assembly 28). The contacts are also identified collectively as a "pair of contacts 38." The load bus 30 and movable contact 32 are in electrical communication. The fixed contact 34 and the line bus 36 are in electrical communication. Each of the load bus 30 and the line bus 36 include a terminal which is disposed outside the housing assembly enclosed space 18. As is known, the terminals of the load bus 30 and the line bus 36 are coupled to, and in electrical communication with a load and a line, respectively (neither shown). Further, and as is known, the circuit breaker assembly 10, in an exemplary embodiment, includes multiple conductor assemblies 14, e.g., one conductor assembly 14 per pole.

The operating mechanism 16 is operatively coupled to each movable contact 32 and is structured to move each movable contact 32 between an open, first configuration, wherein each movable contact 32 is spaced from an associated fixed contact 34, and, a closed, second configuration, wherein each movable contact 32 is directly coupled to, and in electrical communication with, the associated fixed contact 34. The operating mechanism 16 moves between a first configuration and a second configuration corresponding to the configuration of the movable contact 32.

Figure 3:
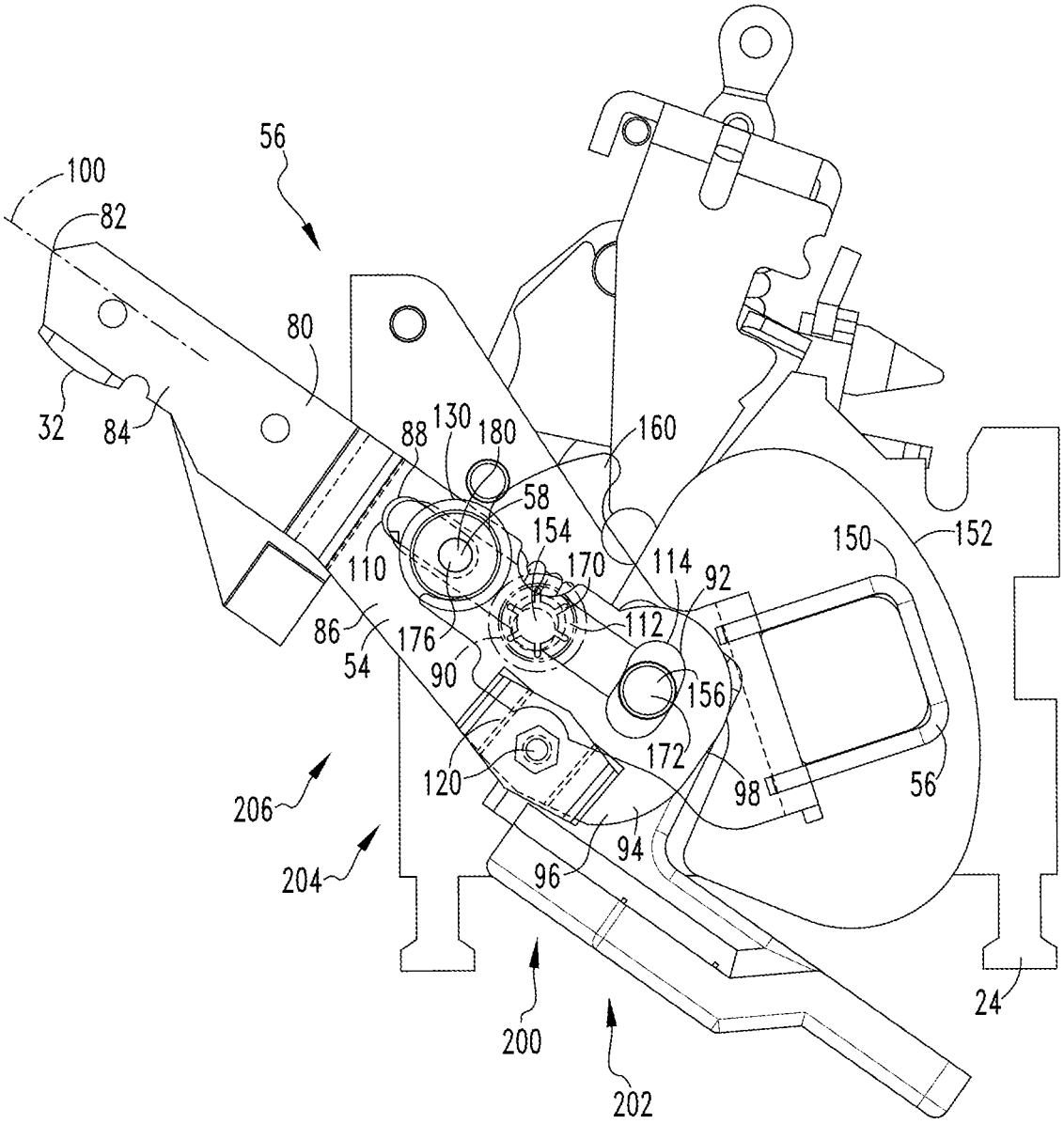
FIG. 3 is a side view of a movable contact conductor assembly in a first position.
Figure 4:
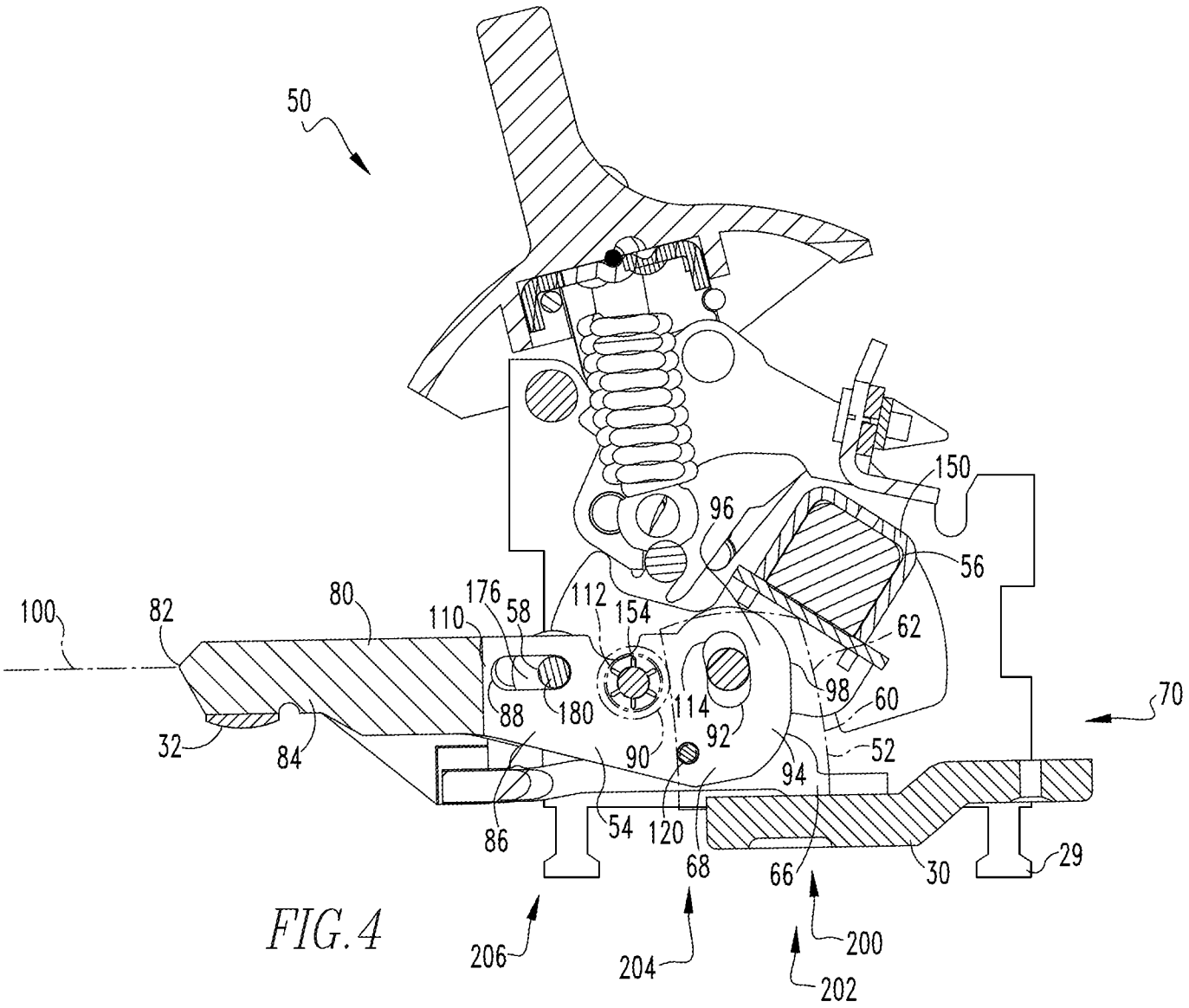
FIG. 4 is a side view of a movable contact conductor assembly in a second position.
Figure 5:
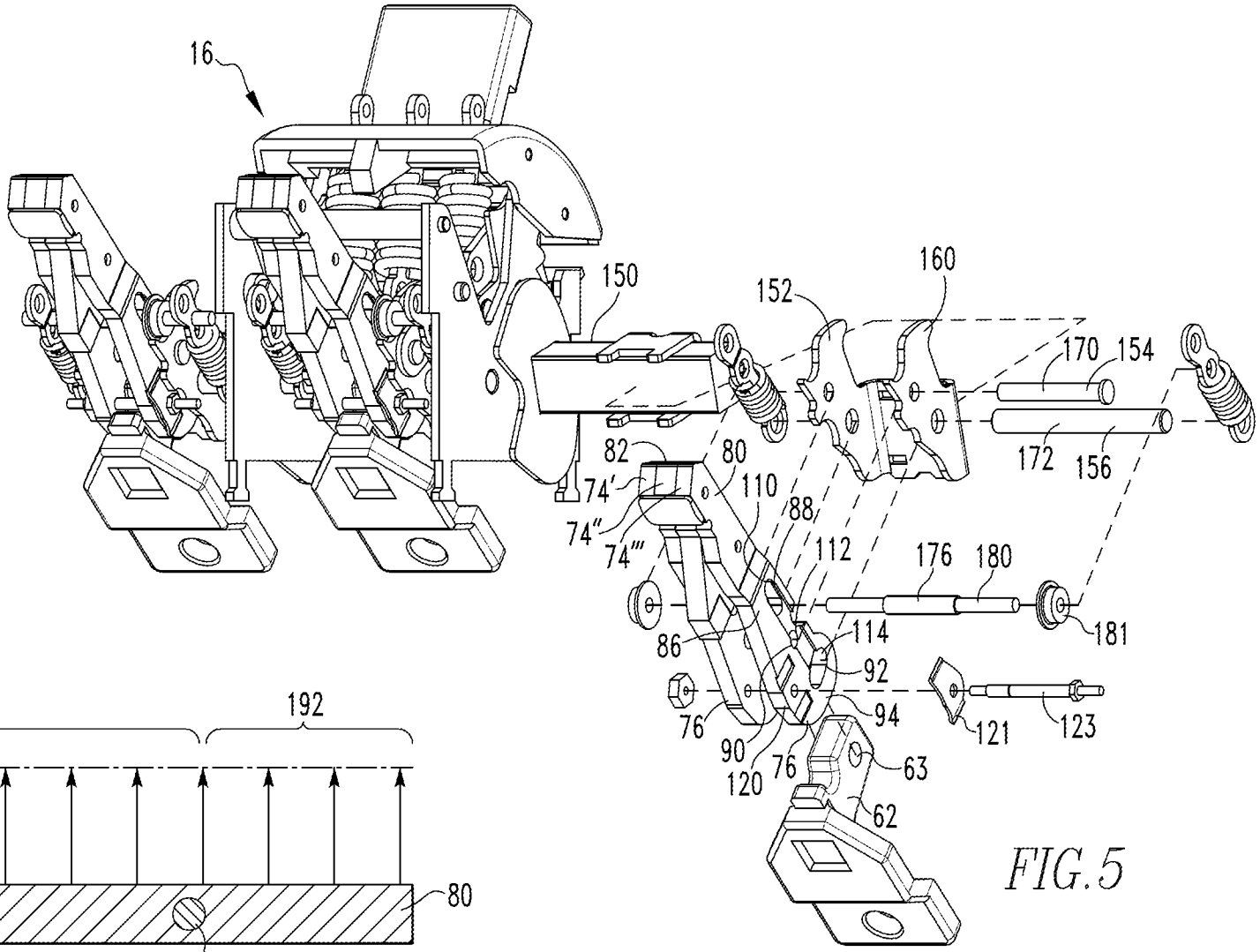
FIG. 5 is a partially exploded view of a conductor assembly.

In an exemplary embodiment, shown in FIGS. 3-5, the movable contact 32 is a movable contact conductor assembly 50. In this embodiment, the movable contact conductor assembly 50 includes a conductive base conductor assembly 52 and a movable contact arm assembly 54. Further, a cross bar assembly 56 and an operating mechanism actuator 58 are, as used herein, considered part of both the operating mechanism 16 and the movable contact conductor assembly 50.

The movable contact conductor assembly 50 includes a number of pivot coupling assemblies or otherwise movable coupling assemblies. As noted above, a "coupling assembly" includes two or more couplings or coupling components. As shown in the figures, and in an exemplary embodiment, the pivot/movable coupling assemblies include a pin, rod, or axle (first component) which extends through an opening (second component) in another elements. For consistency, the pin, or similar element will be described as a "first" component of a coupling assembly and the associated opening will be described as the "second" component of a coupling assembly. Thus, a "second" component of a coupling assembly may be described before the associated "first" component.

The conductive base conductor assembly 52 is part of a "clinch joint." That is, as used herein, a "clinch joint" is a coupling wherein two conductive elements engage each other so that electrical forces generated in the conductive members cannot separate the conductive elements. In an exemplary embodiment, a clinch joint includes a clevis and a generally planar lug wherein in the clevis is a yoke that has tines disposed on either side of the lug. In one exemplary embodiment, not shown, the conductive base conductor assembly 52 is a clevis and the movable contact arm assembly 54 is a generally planar body that acts as a lug. In the embodiment shown, the conductive base conductor assembly 52 includes a conductive body 60 shaped as a generally planar lug 62 with an opening 63 and a pin. The pin, which is a cross bar assembly secondary pivot rod 156, is disposed in the opening and extends generally perpendicular to the plane of the lug 62. As discussed below, the pin, i.e., the cross bar assembly secondary pivot rod 156, is a secondary pivot first component 172. Further, the lug 62 is structured to, and does, engage the movable contact arm assembly 54. That is, the tines 76 of the movable contact arm assembly 54 are biased against the lug 62. In this configuration, the conductive base conductor assembly body lug 62 is a clinch joint first component 70. The conductive base conductor assembly 52 is coupled, directly coupled, or fixed to, and in electrical communication with, the load bus 30. Further, the conductive base conductor assembly 52 and/or the load bus 30 is coupled, directly coupled, or fixed to the housing assembly 12.

The movable contact arm assembly 54 includes an elongated member 80 and, in an exemplary embodiment, includes a conductive shunt 130 which creates a magnetic field when a current passes therethrough. The movable contact arm assembly member 80 is made of a conductive material, such as, but not limited to copper. In an exemplary embodiment, the movable contact arm assembly member 80 is an assembly defining a clevis 72. The movable contact arm assembly member 80 includes a distal tip 82, a first end 84, a medial portion 86, an actuator coupling second component 88, a primary pivot second component 90, a secondary pivot second component 92, a clinch joint second component 94, a second end 96, and a proximal tip 98. As used herein, an "end" includes a portion of the movable contact arm assembly member 80 that extends along a longitudinal axis 100 of the movable contact arm assembly member 80. That is, an "end" is more than the very tip of the movable contact arm assembly member 80. The movable contact arm assembly member first end 84 abuts, i.e., is contiguous with, one side of the movable contact arm assembly member medial portion 86 and the movable contact arm assembly member second end 96 abuts the other side of the movable contact arm assembly member medial portion 86.

The movable contact arm assembly member clevis 72 is disposed at the movable contact arm assembly member second end 96. In an exemplary embodiment, the movable contact arm assembly member 80 includes three conductive, generally planar layers or laminations 74', 74", 74'"; the two outer laminations 74', 74'" extend over the length of the movable contact arm assembly member 80 whereas the middle lamination 74" extends over the movable contact arm assembly member first end 84. In this configuration, the two outer laminations 74', 74'" at the movable contact arm assembly member second end 96 form two spaced tines 76 located at the movable contact arm assembly member second end 96. The two movable contact arm assembly member tines 76 define the movable contact arm assembly member clevis 72.

In an exemplary embodiment, each of the movable contact arm assembly member actuator coupling second component 88, movable contact arm assembly member primary pivot second component 90, and movable contact arm assembly member secondary pivot second component 92, are each an opening in the movable contact arm assembly member 80. It is understood that the axes of the openings extend generally perpendicular to the plane of the movable contact arm assembly member laminations 74', 74", 74'". In an exemplary embodiment, the movable contact arm assembly member actuator coupling second component 88 is an elongated slot 110 extending generally parallel to the movable contact arm assembly member longitudinal axis 100. Further, the movable contact arm assembly member primary pivot second component 90 is a generally circular opening 112. Further, the movable contact arm assembly member secondary pivot second component 92 is one of a generally straight slot (not shown), a generally curvilinear slot (not shown), or a generally arcuate slot 114. As used herein, "generally curvilinear" includes elements having multiple curved portions, combinations of curved portions and planar portions, and a plurality of planar portions or segments disposed at angles relative to each other thereby forming a curve. As used herein, "generally arcuate" means a portion of a generally circular shape wherein the circle has a center. In an exemplary embodiment, the movable contact arm assembly member secondary pivot second component 92 is an arcuate slot 114 with a center disposed generally at the movable contact arm assembly member primary pivot second component 90.

The movable contact arm assembly member actuator coupling second component 88, movable contact arm assembly member primary pivot second component 90, and movable contact arm assembly member secondary pivot second component 92 are disposed in this order along the movable contact arm assembly member longitudinal axis 100. That is, the movable contact arm assembly member actuator coupling second component 88 is disposed between the movable contact arm assembly member distal tip 82 and the movable contact arm assembly member primary pivot second component 90. The movable contact arm assembly member primary pivot second component 90 is disposed between the movable contact arm assembly member actuator coupling second component 88 and the movable contact arm assembly member secondary pivot second component 92. The movable contact arm assembly member secondary pivot second component 92 is disposed between the movable contact arm assembly member primary pivot second component 90 and the movable contact arm assembly member proximal tip 98. As used in this paragraph, "between" is interpreted broadly and includes locations offset from a line extending between the identified end points.

In an exemplary embodiment, the movable contact arm assembly member actuator coupling second component 88 is disposed at the movable contact arm assembly member medial portion 86. Further, the movable contact arm assembly member primary pivot second component 90 is disposed at the movable contact arm assembly member medial portion 86. The movable contact arm assembly member secondary pivot second component 92 is disposed at the movable contact arm assembly member second end 96.

Further, in an exemplary embodiment, the movable contact arm assembly member second end 96 includes a leaf spring area 120, i.e., structured to engage a leaf spring 121 or similar construct. In an exemplary embodiment, the movable contact arm assembly member second end leaf spring area 120 is disposed on one of the movable contact arm assembly member tines 76. Further, the leaf spring 121 is mounted on a rod 123 extending through the movable contact arm assembly member tines 76. The movable contact arm assembly member second end 96, and in an exemplary embodiment, the movable contact arm assembly member second end leaf spring area 120, is a movable contact arm assembly member clinch joint second component 94.

The current carrying shunt 130 is, in an exemplary embodiment, a band of electrically conducting material, such as but not limited to, copper lamination(s) or copper braid, that is disposed about, i.e., encircling, the planar movable contact arm assembly member 80. In an exemplary embodiment, the conductive shunt 130 is coupled, directly coupled, or fixed to the movable contact arm assembly member medial portion 86. That is, the movable contact arm assembly member medial portion 86 includes the conductive shunt 130.

The movable contact 32 is coupled, directly coupled, or fixed to the movable contact arm assembly member 80 at the movable contact arm assembly member distal tip 82 and/or movable contact arm assembly member first end 84.

The cross bar assembly 56 includes an elongated cross bar body 150, a link member 152, a primary pivot rod 154 and a secondary pivot rod 156. The longitudinal axis of the cross bar body 150 extends generally perpendicular to the movable contact arm assembly member longitudinal axis 100 and to the plane of the movable contact arm assembly member laminations 74', 74", 74'". The cross bar assembly link member 152 includes a generally planar body 160. The plane of the cross bar assembly link member body 160 extends in a plane that is generally parallel to the movable contact arm assembly member longitudinal axis 100. The cross bar body 150 is coupled, directly coupled, or fixed to the cross bar assembly link member body 160. The cross bar assembly primary pivot rod 154 extends generally perpendicular to the movable contact arm assembly member longitudinal axis 100 and to the plane of the movable contact arm assembly member laminations 74', 74", 74'", and, generally parallel to the longitudinal axis of the cross bar body 150. The cross bar assembly primary pivot rod 154 is coupled, directly coupled, or fixed to the cross bar assembly link member body 160 and is disposed adjacent the cross bar body 150. The cross bar assembly primary pivot rod 154 is, in this exemplary embodiment, the cross bar assembly primary pivot first component 170. The cross bar assembly secondary pivot rod 156 extends generally perpendicular to the movable contact arm assembly member longitudinal axis 100 and to the plane of the movable contact arm assembly member laminations 74', 74", 74'", and, generally parallel to the longitudinal axis of the cross bar body 150. The cross bar assembly secondary pivot rod 156 is coupled, directly coupled, or fixed to the cross bar assembly link member body 160 and is spaced from the cross bar body 150. That is, the cross bar assembly primary pivot rod 154 and the cross bar assembly secondary pivot rod 156 are spaced from each other. As discussed above, the pin, i.e., the cross bar assembly secondary pivot rod 156, is a secondary pivot first component 172.

The operating mechanism actuator 58 includes an actuator coupling first component 176. In an exemplary embodiment, the actuator coupling first component 176 is a "railroad" (style) wheel axle 180 which supports a wheel 181 (FIG. 5). In an alternate embodiment, not shown, the actuator coupling first component 176 could be another part such as, but not limited to, a pin or a cam and follower (neither shown). The railroad wheel axle 180 is coupled to the operating mechanism 16 and moves therewith. The axis of the railroad wheel axle 180 extends generally perpendicular to the plane of the movable contact arm assembly member 80.

The movable contact arm assembly 54 is assembled as follows. The conductive base conductor assembly lug 62 is disposed between the movable contact arm assembly member tines 76. In this configuration, the movable contact arm assembly member second end leaf spring area 120 is disposed immediately adjacent the conductive base conductor assembly lug 62. The leaf spring 121 is disposed at the movable contact arm assembly member second end leaf spring area 120 on one of the movable contact arm assembly member tines 76. The bias of the leaf spring 121 between the mounting rod 123 and the movable contact arm assembly member second end leaf spring area 120 biases the movable contact arm assembly member tines 76 toward each other thereby causing the movable contact arm assembly member tines 76 to engage the conductive base conductor assembly lug 62. That is, the movable contact arm assembly member second end leaf spring area 120 and the clevis tines 76 are biased against the conductive base conductor assembly lug 62. Thus, movable contact arm assembly member second end leaf spring area 120, which is the movable contact arm assembly member clinch joint second component 94, engages the conductive base conductor assembly lug 62, which is the clinch joint first component 70. It is noted that the engagement of the movable contact arm assembly member second end leaf spring area 120 and the conductive base conductor assembly lug 62 allow for a pivotal, i.e., rotational, movement of the movable contact arm assembly member 80 about the conductive base conductor assembly lug 62. That is, the movable contact arm assembly member 80 pivots generally in the plane of the conductive base conductor assembly lug 62.

Further, in this configuration, the conductive base conductor assembly body 60 is in electrical communication with the movable contact arm assembly member 80. Further, the movable contact arm assembly member secondary pivot second component 92, as shown, the arcuate slot 114, is disposed on the clevis tines 76. Thus, the conductive base conductor assembly clinch joint first component 70 is engageably coupled to the movable contact arm assembly member clinch joint second component 94 thereby forming the clinch joint 200, which is a movable coupling.

The cross bar assembly 56 is rotatably coupled to the conductive base conductor assembly 52 by passing the cross bar assembly secondary pivot first component 172, i.e., cross bar assembly secondary pivot rod 156, through the conductive base conductor assembly lug opening 63, as noted above, as well as the movable contact arm assembly member secondary pivot second component 92, as shown, the arcuate slot 114. Thus, the cross bar assembly secondary pivot first component 172 and the movable contact arm assembly member secondary pivot second component 92 are pivotally, or rotatably, coupled forming a secondary pivot coupling 202. Further, because movable contact arm assembly member secondary pivot second component 92 is a slot 114, movable contact arm assembly member 80 is also movably coupled to the cross bar assembly 56.

Further, the cross bar assembly primary pivot first component 170, i.e., the cross bar assembly primary pivot rod 154, is passed through the movable contact arm assembly member primary pivot second component 90, i.e., the generally circular opening 112. Thus, the cross bar assembly primary pivot first component 170 and the movable contact arm assembly member primary pivot second component 90 are pivotally, or rotatably, coupled forming a primary pivot coupling 204.

Further, the actuator coupling first component 176, as shown railroad wheel axle 180, is passed through the movable contact arm assembly member actuator coupling second component 88, as shown, the elongated slot 110. Thus, the actuator coupling first component 176 and the movable contact arm assembly member actuator coupling second component 88 are movably coupled forming an actuator coupling 206.

In operation, the movable contact arm assembly 54 operates as follows. It is understood that the operating mechanism 16 and the movable contact conductor assembly 50 are initially in the second, closed configuration. In this configuration, a current passes through the conductive base conductor assembly 52 and the movable contact arm assembly member 80 via the conductive shuts 130 (if present) and the clinch joint 200. When an over-current condition occurs, the trip unit assembly detects the over-current condition and causes the operating mechanism 16 and the movable contact arm assembly 54 to move to the first configuration. Before the movable contact arm assembly 54 moves to the first configuration, however, the following occurs.

Figure 6:
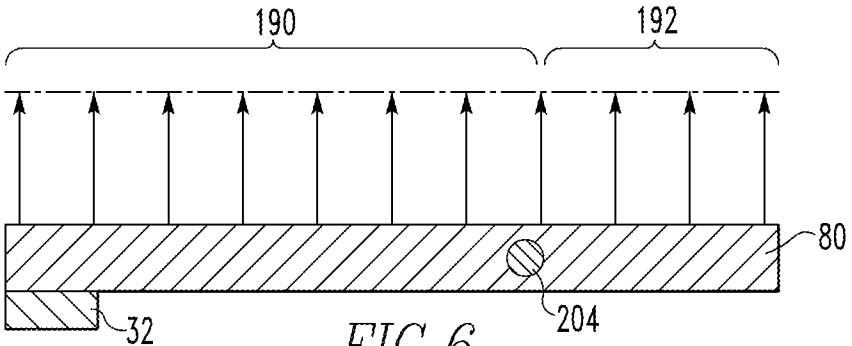
FIG. 6 is a schematic view of loop forces acting on a movable contact conductor assembly body.

The over-current condition, i.e., the current passing through the movable contact arm assembly member 80 generates a loop force, i.e., an electro-magnetic force. The loop force is represented by arrows in the figures. The loop force is generated, generally, along the movable contact arm assembly member longitudinal axis 100 and is directed generally away from the fixed contact 34. Thus, as shown in FIG. 6, a loop force first portion 190 is disposed on a first longitudinal side of the movable contact arm assembly member primary pivot second component 90, and, a loop force second portion 192 is disposed on a second longitudinal side of the movable contact arm assembly member primary pivot second component 90. Because the loop force is directed from the fixed contact 34, the loop first and second portions 190, 192 counteract each other. That is, the loop force first portion 190 creates a counterclockwise torque about movable contact arm assembly member primary pivot second component 90 whereas the loop force second portion 192 creates a clockwise torque about movable contact arm assembly member primary pivot second component 90. Thus, the total torque is reduced and the various components, such as but not limited to the housing assembly 12 and the housing assembly support members 24, do not have to withstand a greater torque. That is, the size, shape and configuration of the noted elements solve the problems stated above.

In an exemplary embodiment, the loop force first portion 190 has a greater longitudinal length than said loop force second portion 192. As used herein, a force having a "greater longitudinal length" means that the identified portion of the loop force is generated over a length of the movable contact arm assembly member 80 that has a greater length than the length of the movable contact arm assembly member 80 that generates the other portion of the loop force.

As the loop force is generated, and as the initial motion, the movable contact 32 moves away from the fixed contact 34 via the movable contact arm assembly member 80 rotating about the primary pivot coupling 204. This motion is accommodated by the movable contact arm assembly member secondary pivot second component 92, i.e., generally arcuate slot 114. That is, even though the movable contact arm assembly member 80 is coupled to the cross bar assembly 56 at two, spaced couplings 202, 204, the arcuate slot 114 allows movable contact arm assembly member 80 to move relative the cross bar assembly secondary pivot first component 172, i.e., cross bar assembly secondary pivot rod 156. This motion is the initial separation of the movable contact 32 from the fixed contact 34 which, in turn, affects the operating mechanism 16 and the operating mechanism actuator 58, which, in an exemplary embodiment, is the actuator coupling first component 176, i.e., railroad wheel axle 180.

Before the movable contact arm assembly member 80 "snaps back," i.e., before there is a counter-rotation about the primary pivot coupling 204, the operating mechanism 16 begins to move to its first configuration. This motion causes the actuator coupling first component 176 to move away from the fixed contact 34. The actuator coupling first component 176 engages the movable contact arm assembly member actuator coupling second component 88 causing the movable contact arm assembly member 80 to rotate about the secondary pivot coupling 202. Further, the motion of the operating mechanism 16 as it moves to its first configuration causes the cross bar assembly 56 to rotate about the secondary pivot coupling 202 as well. As the cross bar assembly 56, and more specifically as the cross bar assembly link member 152, rotates about the secondary pivot coupling 202, the primary pivot coupling 204 is moved away from the fixed contact 34. Thus, before the movable contact arm assembly member 80 "snaps back," the movable contact arm assembly member distal tip 82 and/or movable contact arm assembly member first end 84 where the movable contact 32 is located, moves away from the fixed contact 34. After the movable contact arm assembly member 80 pivots about the secondary pivot coupling 202, the movable contact arm assembly member 80 "snaps back" to its initial orientation relative to the cross bar assembly link member 152. Thus, the size, shape and configuration of the noted elements solve the problems stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A movable contact arm assembly for a circuit breaker assembly, the circuit breaker assembly including a housing assembly, a conductor assembly, and an operating mechanism, said housing assembly defining a substantially enclosed space, said conductor assembly including a fixed contact conductor assembly and a movable contact conductor assembly, said conductor assembly substantially disposed in said housing assembly enclosed space, said fixed contact conductor assembly including a fixed contact, said movable contact conductor assembly including a cross bar assembly and a conductive base conductor assembly, said cross bar assembly including a primary pivot first component and a secondary pivot first component, said conductive base conductor assembly including a clinch joint first component, said operating mechanism including an actuator coupling first component, said operating mechanism operatively coupled to said movable contact conductor assembly and structured to move a movable contact arm assembly between an open, first position and a closed, second position, said movable contact arm assembly comprising:

an elongated member including a distal tip, a first end, a medial portion, an actuator coupling second component, a primary pivot second component, a secondary pivot second component, a clinch joint second component, a second end, and a proximal tip;

wherein, during an over-current event, said movable contact arm assembly member generates a loop force;

wherein a loop force first portion is disposed on a first longitudinal side of said movable contact arm assembly member primary pivot second component, and, a loop force second portion is disposed on a second longitudinal side of said movable contact arm assembly member primary pivot second component;

wherein said loop force first portion has a greater longitudinal length than said loop force second portion; and wherein at least one of said movable contact arm assembly member first end and said movable contact arm assembly member medial portion includes a conductive shunt.

2. A movable contact conductor assembly for a circuit breaker assembly, the circuit breaker assembly including a housing assembly, a conductor assembly, and an operating mechanism, said housing assembly defining a substantially enclosed space, said conductor assembly including a fixed contact conductor assembly substantially disposed in said housing assembly enclosed space, said fixed contact conductor assembly including a fixed contact, said operating mechanism including an actuator coupling first component, said operating mechanism operatively coupled to said conductor assembly and structured to move a movable contact arm assembly between an open, first position and a closed, second position, said movable contact conductor assembly comprising:

a cross bar assembly including a primary pivot first component and a secondary pivot first component;

a conductive base conductor assembly including a clinch joint first component;

a movable contact arm assembly including an elongated member including a distal tip, a first end, a medial portion, an actuator coupling second component, a primary pivot second component, a secondary pivot second component, a clinch joint second component, a second end, and a proximal tip;

said conductive base conductor assembly clinch joint first component engageably coupled to said movable contact arm assembly member clinch joint second component;

said cross bar assembly primary pivot first component pivotally coupled to said contact arm assembly body primary pivot second component;

said cross bar assembly secondary pivot first component pivotally coupled to said contact arm assembly body secondary pivot second component;

wherein, during an over-current event, said movable contact arm assembly member generates a loop force;

wherein a loop force first portion is disposed on a first longitudinal side of said movable contact arm assembly member primary pivot second component, and, a loop force second portion is disposed on a second longitudinal side of said movable contact arm assembly member primary pivot second component;

wherein said loop force first portion has a greater longitudinal length than said loop force second portion; and wherein at least one of said movable contact arm assembly member first end and said movable contact arm assembly member medial portion includes a conductive shunt.

3. A circuit breaker assembly, the circuit breaker assembly comprising:

a housing assembly defining a substantially enclosed space;

a conductor assembly including a fixed contact conductor assembly and a movable contact conductor assembly;

said fixed contact conductor assembly substantially disposed in said housing assembly enclosed space and including a fixed contact;

an operating mechanism including an actuator coupling first component;

said operating mechanism operatively coupled to said conductor assembly and structured to move a movable contact arm assembly between an open, first position and a closed, second position;

said movable contact conductor assembly substantially disposed in said housing assembly enclosed space and including a cross bar assembly, a conductive base conductor assembly, and a movable contact arm assembly;

said cross bar assembly including a primary pivot first component and a secondary pivot first component;

said conductive base conductor assembly including a clinch joint first component;

said movable contact arm assembly including an elongated member including a distal tip, a first end, a medial portion, an actuator coupling second component, a primary pivot second component, a secondary pivot second component, a clinch joint second component, a second end, and a proximal tip;

said conductive base conductor assembly clinch joint first component engageably coupled to said contact arm assembly body clinch joint second component;

said cross bar assembly primary pivot first component pivotally coupled to said contact arm assembly body primary pivot second component;

said cross bar assembly secondary pivot first component pivotally coupled to said contact arm assembly body secondary pivot second component;

said operating mechanism actuator coupling first component coupled to said movable contact arm assembly member actuator coupling second component;

wherein, during an over-current event, said movable contact arm assembly member generates a loop force;

wherein a loop force first portion is disposed on a first longitudinal side of said movable contact arm assembly member primary pivot second component, and, a loop force second portion is disposed on a second longitudinal side of said movable contact arm assembly member primary pivot second component;

wherein said loop force first portion has a greater longitudinal length than said loop force second portion; and wherein at least one of said movable contact arm assembly member first end and said movable contact arm assembly member medial portion includes a conductive shunt.

4. A movable contact arm assembly for a circuit breaker assembly, the circuit breaker assembly including a housing assembly, a conductor assembly, and an operating mechanism, said housing assembly defining a substantially enclosed space, said conductor assembly including a fixed contact conductor assembly and a movable contact conductor assembly, said conductor assembly substantially disposed in said housing assembly enclosed space, said fixed contact conductor assembly including a fixed contact, said movable contact conductor assembly including a cross bar assembly and a conductive base conductor assembly, said cross bar assembly including a primary pivot rod and a secondary pivot rod, said conductive base conductor assembly including a clinch joint first component, said operating mechanism including an actuator coupling first component, said operating mechanism operatively coupled to said movable contact conductor assembly and structured to move a movable contact arm assembly between an open, first position and a closed, second position, said movable contact arm assembly comprising:

an elongated member including a distal tip, a first end, a medial portion, an actuator coupling second component, a primary pivot opening, a secondary pivot slot, a clinch joint second component, a second end, and a proximal tip;

wherein, during an over-current event, said movable contact arm assembly member generates a loop force;

wherein a loop force first portion is disposed on a first longitudinal side of said movable contact arm assembly member primary pivot opening, and, a loop force second portion is disposed on a second longitudinal side of said movable contact arm assembly member primary pivot opening; and wherein at least one of said movable contact arm assembly member first end and said movable contact arm assembly member medial portion includes a conductive shunt.

* * * * *